US006945623B2

(12) United States Patent
Sakamoto et al.

(10) Patent No.: US 6,945,623 B2
(45) Date of Patent: Sep. 20, 2005

(54) INKJET PRINTING APPARATUS

(75) Inventors: Atsushi Sakamoto, Kanagawa (JP); Hidehiko Kanda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 110 days.

(21) Appl. No.: 10/625,739

(22) Filed: Jul. 24, 2003

(65) Prior Publication Data

US 2004/0150682 A1 Aug. 5, 2004

(30) Foreign Application Priority Data

Jul. 30, 2002 (JP) ..... 2002-222058

(51) Int. Cl.[7] ..... B41J 2/195; B41J 29/393
(52) U.S. Cl. ..... 347/7; 347/19
(58) Field of Search ..... 347/7, 14, 19, 347/23, 35, 30

(56) References Cited

U.S. PATENT DOCUMENTS 5,475,404 A * 12/1995 Takahashi et al. ..... 347/23
5,606,353 A * 2/1997 Mochizuki et al. ..... 347/23
5,625,384 A * 4/1997 Numata et al. ..... 347/23
5,659,342 A * 8/1997 Lund et al. ..... 347/35
5,805,182 A * 9/1998 Lee ..... 347/35
5,856,834 A * 1/1999 Murphy, III ..... 347/23
5,949,447 A 9/1999 Arai et al. ..... 347/23
6,027,196 A 2/2000 Gotoh et al. ..... 347/7
6,142,600 A 11/2000 Takahashi et al. ..... 347/23
6,382,765 B1 * 5/2002 Kanda et al. ..... 347/23
6,702,421 B2 * 3/2004 Inui et al. ..... 347/23
2003/0063142 A1 4/2003 Sakamoto et al. ..... 347/5

* cited by examiner

*Primary Examiner*—Thinh Nguyen
(74) *Attorney, Agent, or Firm*—Fitzpatrick, Cella, Harper & Scinto

(57) ABSTRACT

In an inkjet printing apparatus utilizing an inkjet head and an ink tank for supplying ink to the same, it is made possible to suppress any reduction in image quality attributable to changes in physical and chemical properties of the ink that occur during an elapsed time from the manufacture of the ink tank to the use of the same, thereby allowing images to be formed with high reliability and stability at a low running cost. The apparatus has a discharging unit for discharging the ink through a nozzle at the head and an ink detecting unit for detecting the consumption of the ink in the ink tank. The detected ink consumption is compared with a threshold for ink consumption appropriately determined based on the elapsed time, and control is performed such that the amount discharged by the discharging unit is increased when the ink has not been consumed sufficiently.

11 Claims, 7 Drawing Sheets

| ELAPSED TIME AFTER MANUFACTURE | INK CONSUMPTION THRESHOLD |
|---|---|
| 0 - 3 MONTHS | 0.0g |
| 3 - 6 MONTHS | 1.0g |
| 6 - 12 MONTHS | 1.5g |
| 12 - 24 MONTHS | 2.0g |
| 24 MONTHS OR MORE | 2.5g |

FIG.7

INKJET PRINTING APPARATUS

This application claims priority from Japanese Patent Application No. 2002-222058 filed Jul. 30, 2002, which is incorporated hereinto by reference.

BACKGROUND OF THE INVENTION

1. Field of the Invention

The present invention relates to an inkjet printing apparatus and, more particularly, to a printing apparatus using an inkjet printing method in which images are formed by forming ink dots on a printing medium.

2. Description of the Related Art

An inkjet printing method is a method of printing in which images are formed by ejecting ink in a single color or a plurality of colors prepared for color printing onto various printing media such as paper, cloth, unwoven fabric, and plastic films for OHPs.

Inkjet printing apparatus employing this method include a so-called serial type inkjet printing apparatus having a carriage on which a printing unit (printing head) is mounted and which performs main scanning in a predetermined direction on a printing medium, a transport unit for transporting the printing medium in a direction different from the main scanning direction (sub-scanning), and a control unit for controlling those units. Ink is ejected from a plurality of ink ejecting openings provided on the printing head while performing serial scanning of the printing head in the main scanning direction. The printing head is transported a predetermined distance between serial scannings (e.g., a printing width that is achieved by one main scan and that is equivalent to the range in which the ejection openings are arranged). Thus, printing is sequentially performed on the printing medium.

Methods of supplying ink to a printing head used in an inkjet printing apparatus of this type include a method in which an ink tank is integrally or separably mounted on a printing head that is mounted on a carriage to be moved back and forth (main scanning) to supply ink to the same and a method in which an ink tank is provided separately from a printing head mounted on a carriage and is fixedly installed in a position in the printing apparatus other than the position of the head and in which ink is supplied by connecting the ink tank and the printing head through a flexible tube. Other methods include a method in which a supply system is configured such that ink is always or continuously supplied from an ink tank to a printing head in an amount in accordance with the amount of ejected ink and a method in which a printing head is provided with a reservoir section for reserving or storing a predetermined amount of ink (an amount to serve a sheet of printing medium, for example) and in which a supply system is configured such that ink is supplied at appropriate timing or intermittently to the reserving section from an ink supply source having a relatively great capacity.

Recording methods called full-multi or line types are also known which utilize a printing head having a multiplicity of nozzles arranged in a range that corresponds to the entire width of a printing medium and in which printing is performed while transporting the printing medium relative to the printing head in the longitudinal direction thereof (sub-scanning direction). In the case of such a full-multi type apparatus, there is no mechanism for scanning a carriage, unlike a serial type; an ink tank is fixedly mounted in another part of the apparatus.

Among such inkjet printing methods, the so-called drop-on-demand method in which printing is performed by ejecting ink directly onto a printing medium in accordance with printing signals is widely used as an easy and inexpensive method of printing.

The most widely known inkjet printing apparatus as described above are types in which an ink tank is provided in the form of a cartridge and in which the ink is replenished when used up by replacing the cartridge with a new one (cartridge replacement types).

There are various configurations for an ink tank as described above including a configuration in which an absorber in the form of a sponge or fabric is contained in the tank to fill the interior of the same and in which the absorbing element is impregnated with ink utilizing a capillary force thereof to hold the ink, a configuration which includes a section for containing such an absorber and another containing section for reserving ink as it is, and a configuration in which a bag is provided in a tank to contain only ink therein and in which a negative pressure is generated with a spring provided between the bag and an outer wall of the ink tank.

Inks used in inkjet printing apparatus are generally categorized into pigment type inks and dye type inks. Depending on purposes of use, some inkjet printing apparatus use dye type inks only; some inkjet printing apparatus use pigment type inks only; and some inkjet printing apparatus use both of dye type and pigment type inks. In some of inkjet printing apparatus that use both of dye type and pigment type inks, a pigment type black ink is used for printing of images that primarily involve black such as texts, and dye type color inks are used for printing of images that are primarily in colors such as those provided by a digital camera.

In using an inkjet printing apparatus, a user buys a new cartridge when ink runs out to replace the cartridge that has been used up as described above. Normally, such cartridges travel various routes of physical distribution for various physical distribution periods before they reach users. Changes can occur in the physical and chemical properties of inks in cartridges that have traveled various routes of physical distribution for various physical distribution periods. Specifically, components of an ink can be combined with each other to become particles having greater diameters or settlings in some occasions. Further, some types of ink easily undergo such changes in physical and chemical properties.

When such an ink including particles having greater diameters or settlings is supplied to a printing head, the ink can clog ink ejection openings and liquid passages in communication therewith to result in an ejection failure. In the case of a printing head in which a heater is used to generate thermal energy as energy for ink ejection, such an ink can cause problems such as kogation or burning which can damage the printing head.

In the case of inkjet printing apparatus for industrial purposes that perform printing on relatively large printing media as those used in the fields of textile printing and commercial printing, a cartridge can be continuously used without becoming a waste when it has a configuration that allows the ink to be replenished properly in accordance with the progress of ink consumption. However, settlings can be deposited on the bottom while the cartridge is used for a long time while being replenished with ink repeatedly.

In order to prevent problems attributable to the use of an ink whose condition has changed in a cartridge, there are proposals on an inkjet printing apparatus having a transport unit aimed at agitation of an ink separate from a transport unit for replenishing an ink chamber with the ink and an inkjet printing apparatus in which a single pump mechanism is used for both of replenishment and agitation of an ink. The purpose is to agitate an ink whose condition has changed in a cartridge, thereby stirring settlings into the ink again to achieve a uniform condition.

In some inkjet printing apparatus having no agitating unit, changes of a certain degree in ink condition on the way of physical distribution and during a physical distribution period are assumed; the portion of the ink whose condition is assumed to have changed is discharged when the cartridge is replaced with new one using a pump unit that is provided in the inkjet printing apparatus for the purpose of charging ink; and printing is performed using the remaining ink.

However, such inkjet printing apparatus have the following problems to be solved.

An ink supply unit and an agitating unit provided in an inkjet printing apparatus create problems such as an increase in the size of a main body of the apparatus and an increase in the manufacturing cost of the apparatus main body, and those units are therefore unsuitable for inkjet printing apparatus to be used in offices or homes.

Even when an ink supply unit serves also as an agitating unit, sufficient agitating performance cannot be achieved in a configuration in which an ink is held in the interior of an ink tank as a whole with a capillary force of an absorber in the form of a sponge or fabric.

Assuming that an ink discharging condition is determined for a long physical distribution period, when a user actually installs and uses an ink tank that has been distributed for a short time, the ink will be discharged in the same amount as that discharged from an ink tank that takes a long time to be distributed. This results in an indiscriminate increase in the running cost.

Assuming that an ink discharging condition is determined for a short physical distribution period, when a user actually installs and uses an ink tank that has been distributed for a long time, the ink will be discharged only in the same amount as that discharged from an ink tank that takes a short time to be distributed. There will be an ink residue whose condition has changed in the ink chamber of the printing head, which can result in problems such as an ejection failure or disabled ejection in nozzles that are not in use.

Such an ejection failure is unlikely to occur at nozzles that are continuously used and is likely to occur at nozzles that are intermittently used (nozzles associated with inks that are not used for forming a certain image).

It is considered that the failure is likely to occur at the intermittently used nozzles because of a difference between quantities of heat accumulated at the continuously used nozzles and the intermittently used nozzles.

SUMMARY OF THE INVENTION

The invention has been made to solve such problems, and it is an object of the invention to provide an inkjet printing apparatus in which a suitable process is taken depending on changes in physical properties and chemical properties of an ink to suppress wasteful consumption of the ink and to perform stable printing at a low cost.

Specifically, in an inkjet printing apparatus using an inkjet printing head and an ink tank for supplying an ink to the inkjet printing head, it is an object of the invention to provide stable images with high reliability at a low running cost by suppressing problems such as an ejection failure or disabled ejection attributable to changes in physical and chemical properties of the ink that occur depending on the time spent before the ink tank is delivered to the user via a route of physical distribution.

In an aspect of the present invention, there is provided an inkjet printing apparatus for forming an image using a printing head for ejecting ink and an ink containing section for containing the ink to be supplied to the printing head, comprising:

means for discharging the ink through an ink ejection opening of the printing head to stabilize ink ejecting characteristics of the printing head;

means for detecting the degree of use of the ink in the ink containing section;

means for comparing the detected degree of use of the ink with a predetermined value; and control means for changing the amount discharged by the discharging means in accordance with the result of the comparison.

The above and other objects, effects, features and advantages of the present invention will become more apparent from the following description of embodiments thereof taken in conjunction with the accompanying drawings.

BRIEF DESCRIPTION OF THE DRAWINGS

FIG. 7 is a graph showing ink consumption thresholds that depend on elapsed times after manufacture that are set based on the density distributions relative to the standing periods shown in FIG. 6.

DETAILED DESCRIPTION OF PREFERRED EMBODIMENTS

The invention will now be described in detail with reference to the drawings.

[First Embodiment]

Figure 1:
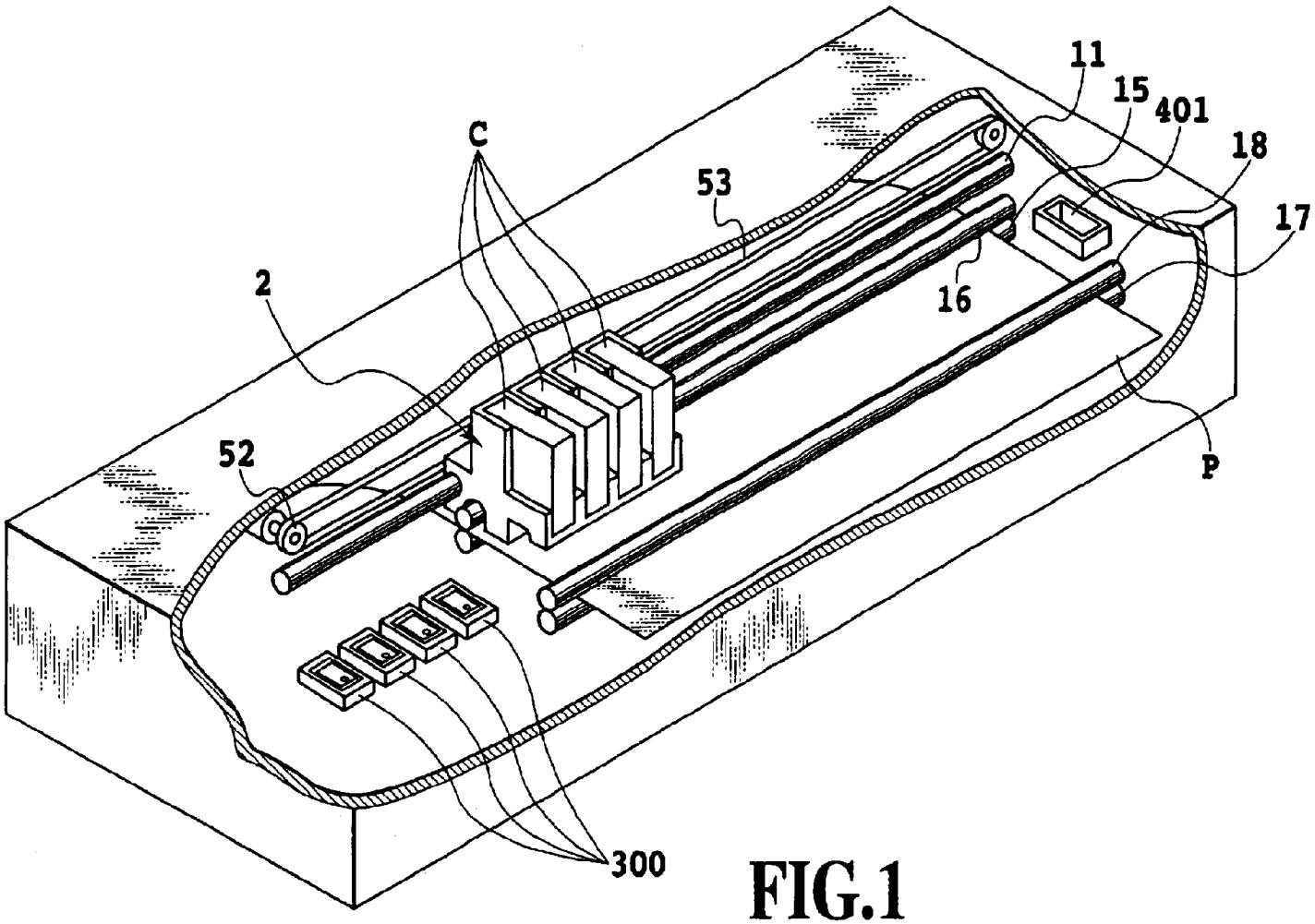
FIG. 1 is a schematic perspective view of an inkjet printing apparatus to which the invention can be applied.

FIG. 1 is a perspective view showing a schematic configuration of a printing apparatus having a printing head for performing printing in accordance with the inkjet method that is a typical embodiment of the invention.

In FIG. 1, reference character C represents inkjet cartridges (hereinafter simply referred to as "cartridges") that have an ink tank in an upper part thereof and a printing head in a lower part thereof and that is provided with a connector for receiving a signal for driving the printing head. Reference numeral 2 represents a carriage on which a plurality of cartridges C are mounted. Inks in different colors such as yellow, magenta, cyan, and black inks are contained in the ink tanks of the plurality of cartridges C, respectively. The carriage 2 is provided with connector holders that transmit signals for driving the printing heads of the respective cartridges C and that are electrically connected to the printing heads. In the example shown in FIG. 1, four cartridges C are provided which contain yellow, magenta, cyan, and black inks, from the left, in the respective ink tanks, the inks being listed in the order starting with the yellow ink located leftmost in the figure.

Reference numeral 11 represents a scanning rail that extends in a direction in which the printing head is scanned (main scanning direction) to slidably support the carriage 2. Reference numeral 52 represents a carriage motor. Reference numeral 53 represents a drive belt that transmits a driving force of the carriage motor 52 for moving the carriage 2 back and forth in the main scanning direction. Reference numerals 15 and 16 and reference numerals 17 and 18 respectively represent pairs of transport rollers that are provided upstream and downstream of a position where printing is performed on a printing medium by the printing heads and that sandwich the printing medium to transport the same. Reference character P represents a printing medium such as paper. The printing medium P is urged against a guide surface of a platen (not shown) for regulating a printing surface of the medium such that it is kept flat.

The printing heads provided at cartridges C mounted on the carriage 2 protrude downward from the carriage 2 and reside between the transport rollers 16 and 18, such that ejection opening forming surfaces of the printing heads having ejection openings formed thereon face the printing medium P that is urged against the guide surface of the platen (not shown) in parallel with the same.

A recovery system unit as a discharging unit is disposed on the left side of the printing apparatus of the present embodiment as shown in FIG. 1 (the position being referred to as "home position").

Referring to the recovery system unit in FIG. 1, reference numeral 300 represents cap units that are provided in association with the printing heads provided at each of the four cartridges C and that can be elevated in the vertical direction. The cap units 300 are joined with the printing heads to cap them when the carriage 2 is in the home position, which prevents evaporation of the inks in the ejection openings of the printing heads, an increase in the viscosity of the inks, or an ejection failure attributable to evaporation, solidification and deposition of volatile components.

Figure 2:
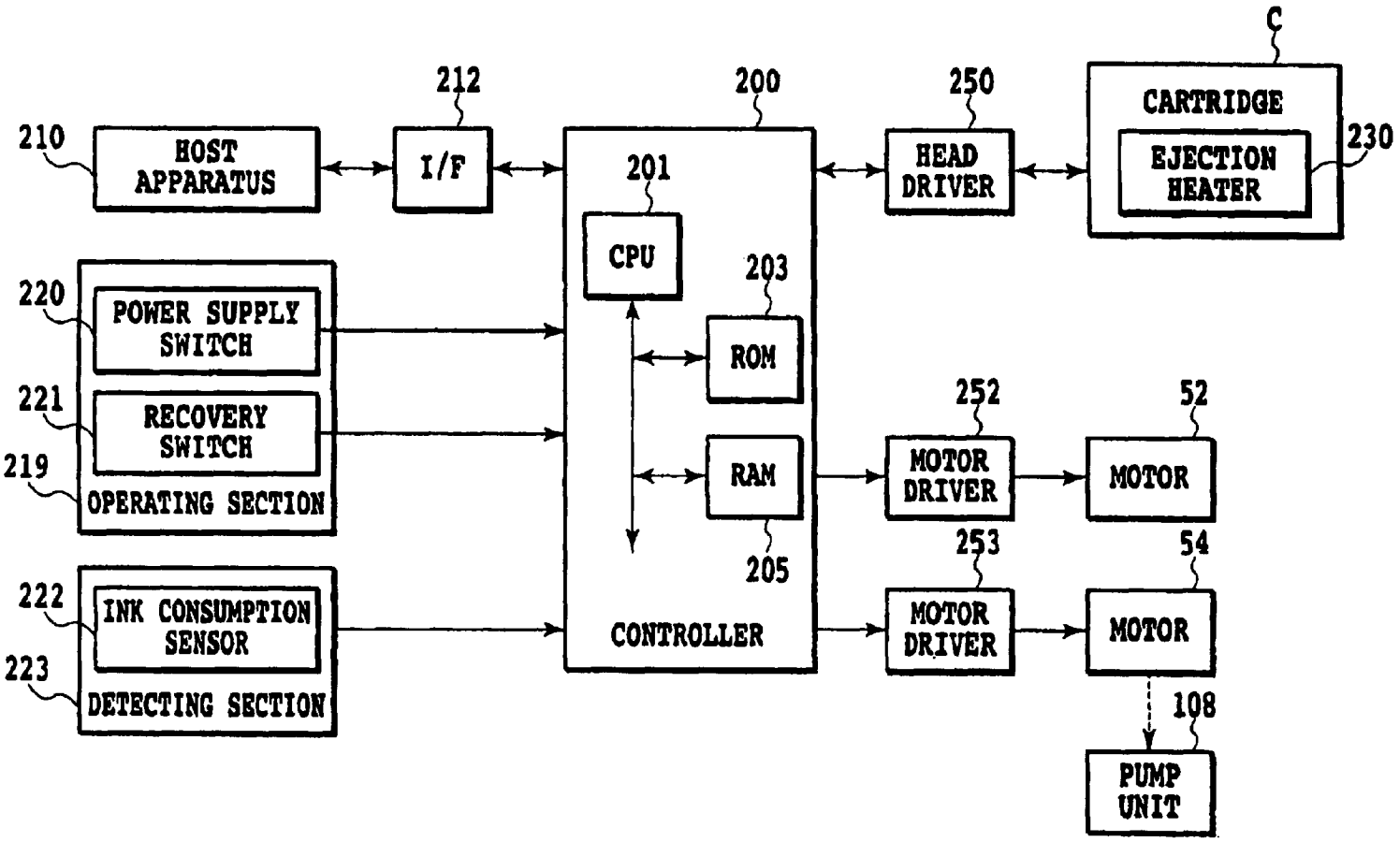
FIG. 2 is a block diagram showing an example of a schematic configuration of the control system in FIG. 1.

The interior of the cap units 300 is in communication with pump unit 108(FIG. 2). The pump unit 108 generates a negative pressure as occasions demand. For example, a negative pressure is generated when a suction recovery operation is performed by joining the cap units 300 and the printing heads in case of an ejection failure of the printing heads or when inks ejected on a preliminary basis in the caps of the cap units 300 are sucked.

Reference numeral 401 represents a preliminary ejection receiving section which is provided opposite to the home position with an area for a printing operation on the printing medium P interposed between them. Ink that is unsuitable or possibly unsuitable for printing is discharged by ejecting the ink from the printing head to the preliminary ejection receiving section 401 (preliminary ejection) at a proper timing. Further, a configuration may be employed in which the recovery system unit is provided with a blade constituted by an elastic member such as rubber to wipe condensation that has formed on the ejection opening forming surfaces of the printing heads.

In the printing apparatus of the present embodiment, a single motor is commonly used as a transportation driving motor for transporting the printing medium P and a driving motor for operating the recovery system unit.

FIG. 2 is a block diagram showing an example of a schematic structure of a control system in the inkjet printing apparatus in FIG. 1.

In FIG. 2, a controller 200 serves as a main control section and has a CPU 201 in the form of a microcomputer, a ROM 203 in which fixed data such as programs and required tables are stored, and a RAM 205 having areas such as an area for arranging image data and a work area, for example. A host apparatus 210 is a supply source of image data and may be a computer for generating and processing data such as image data to be printed and may alternatively be a reader for reading images or a digital camera.

Image data, commands, and status signals are transmitted and received to and from the controller 200 through an interface 212. An operating section 219 has a power supply switch 220 and switches for accepting input of instructions of an operator such as recovery switch 221 for instructing activation of suction recovery. A detecting section 223 has sensors for detecting states of the apparatus such as a sensor 222 for detecting the degree of use of the ink, for example, for detecting the consumption of the ink.

A head driver 250 is a driver for driving electrothermal transducers (ejection heaters) 230 of the printing head according to printing data. Reference numeral 252 represents a motor driver for driving the carriage motor 52. Reference numeral 253 represents a motor driver for driving a motor 54 commonly used for transporting the printing medium P and driving the pump unit 108.

Figure 3:
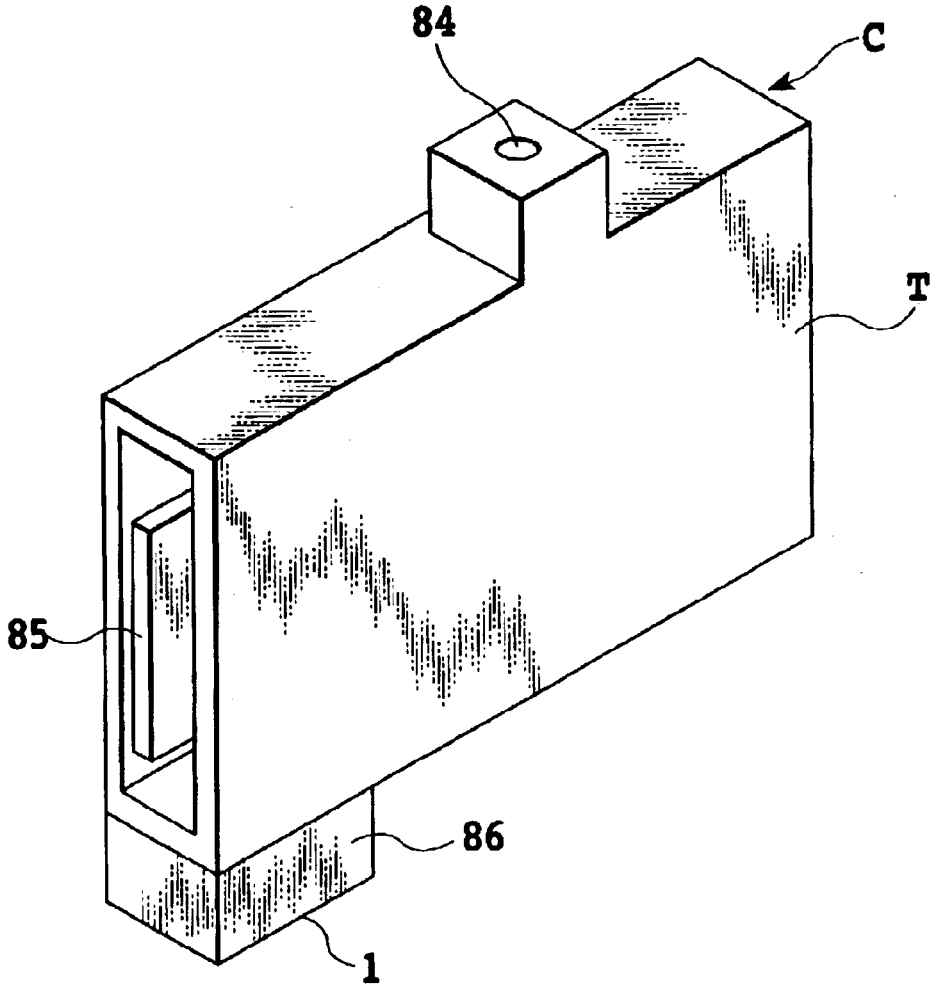
FIG. 3 is a perspective view of an inkjet cartridge used in the inkjet printing apparatus in FIG. 1.

FIG. 3 is a perspective view of an inkjet cartridge C comprised of a printing head and an ink tank that are integral with each other.

The cartridge C has an ink tank T in an upper part thereof and a printing head 86 in a lower part thereof as shown in FIG. 3. An air hole 84 is provided on the top of the ink tank T, and a head side connector 85 is provided at one side of the ink tank T. The connector 85 receives signals for driving the printing head 86. When an ink consumption detecting unit or remaining ink amount detecting unit is provided at the ink tank T, the connector outputs detection signals thereof.

Various sensors may be used as the ink consumption detecting unit or remaining ink amount detecting unit, e.g., a sensor which is provided in the ink tank T to detect a level of ink optically. Their functions may be provided as processes in the main body of the printing apparatus instead of using such a hardware-based configuration. Specifically, the ink consumption detecting unit may be means for calculating ink consumption by detecting the number of dots associated with the ink acquired from image data or detecting a value that is the amount of ink discharged on a preliminary basis expressed in terms of the number of dots, for example. The remaining ink amount detecting unit may be means for calculating the amount of remaining ink by subtracting the ink consumption from a predetermined ink tank capacity, for example. If employing detecting means in which ink consumption or ink remaining amount is calculated as set forth above, a calculated value is to be reset or set at a predetermined value upon exchanging the ink tank T.

The printing head 86 is formed with an ejection opening surface 1 having a plurality of ejection openings provided on the bottom of the same and cannot be seen in the figure. For example, an electrothermal transducer for generating thermal energy as energy to be used for ejecting ink is provided in a liquid path that is in communication with each ejection opening.

The ink tanks T of the cartridges C may contain dye type inks and pigment type inks depending on the specifications and characteristics of the printers. In general, when a pigment type ink having water-solubility lower than that of a dye type ink is contained, the ink can cause phenomena such as coagulation and settling of the coloring material after a long period of preservation of the same in the ink tank. When such a phenomenon occurs, the coloring material which has been distributed with a uniform density in the ink tank T is changed in distribution such that the density becomes higher closer to the bottom of the ink tank T in the attitude or orientation in which the tank is left standing. When a portion of the ink whose coloring material density has thus increased is supplied to the ejecting section of the printing head, ejection can become unstable or clogging can occur during supplying to disable ejection.

Figure 4:
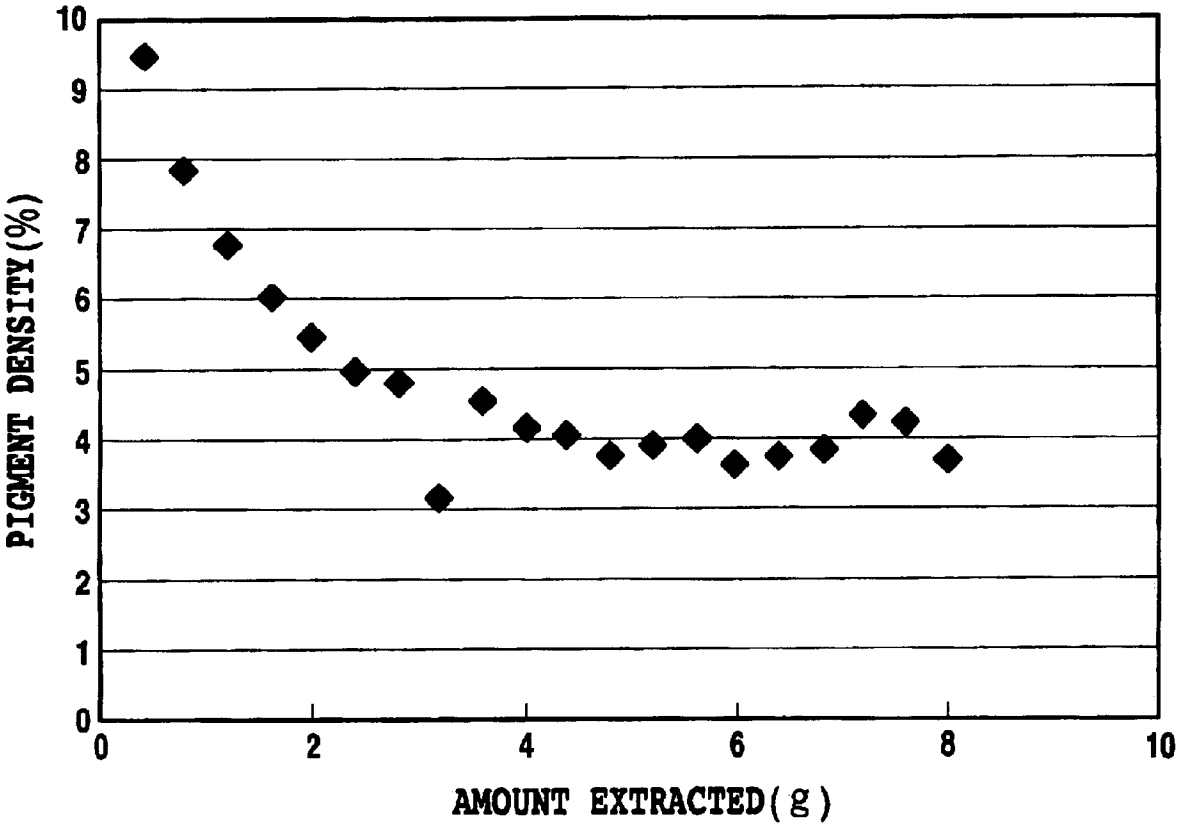
FIG. 4 is a graph showing a distribution of pigment densities of a certain pigment ink, the distribution being observed by putting the ink in an ink tank configured such that its interior is fully occupied by a porous absorber in the form of a sponge contained therein to hold an ink with a capillary force thereof, letting the tank stand for one year with an ink supply hole thereof facing downward, and extracting the ink from the ink supply hole.

FIG. 4 is a graph showing a distribution of pigment densities of a certain pigment ink, the distribution being observed by putting the ink in an ink tank configured such that its interior is fully occupied by a porous absorber in the form of a sponge contained therein to hold an ink with a capillary force thereof, letting the tank stand for one year with an ink supply hole thereof facing downward, and extracting the ink from the ink supply hole.

Pigment densities and amounts of extracted ink are plotted along the ordinate axis and abscissa axis, respectively. The ink has an initial pigment density of 4.0% when it is charged, and the density varies in the range from about 3.5% to 9.5% one year later depending on the amounts extracted. The closer the amount of extracted ink comes to 0, the higher the pigment density. This is considered attributable to the fact that the tank has been left for one year in the orientation in which the ink supply hole has faced downward to cause coagulation and settling of the pigment.

Ejection control (e.g., control over the ink ejection amount through adjustment of the driving energy of the electrothermal transducer) is performed to allow stable ink ejection when a density error stays within about 50% of the initial density. In the case of a greater density error, however, normal ejection control may fail to keep stable ejection because of significant changes in refill characteristics and sticking characteristics of the ink.

For example, let us assume that an image is printed using only color inks in yellow, magenta, and cyan. In the case of a pigment type black ink, when only normal preliminary ejection is performed to discharge the black ink from the printing head, the black ink may be in a state in which a density error cannot be corrected with normal ejection control. Therefore, preliminary ejection of an ink having a high pigment density can result in image problems such as disturbances in an image attributable to a reduction of the ejecting speed and voids in an image attributable to disabled ejection unless the ink is ejected in an amount greater than that of normal preliminary ejection to sufficiently discharge a portion of the ink that is in a state unsuitable for printing (i.e., a state that cannot be dealt with normal ejection control). For example, such a phenomenon can occur when a black image is printed after printing a great number of color images.

In order to prevent such a phenomenon, a suction process maybe performed to achieve a density at which stable ink ejection characteristics are achieved when an ink tank is installed in a printing head to discharge ink with high density, which makes it possible to output stable images.

For example, in the case of the pigment ink having the pigment density distribution shown in FIG. 4, what is needed is to discharge the ink from the ink chamber by sucking about 1.5 g of the ink when the ink tank is installed in the printing head.

According to such a method, however, when it is unknown how long an ink tank has not been used because no information is available on the manufacturing date of the ink tank, the discharging process must be performed on every ink tank on an assumption that they have not been used for a considerably long period since the manufacture of the same until the user obtains them through physical distribution and starts actually using them. Since the gradient of the density distribution tends to increase with the unused period, when a long unused period is assumed, a great amount of ink must be discharged until it can be considered that a stable density has been reached. As a result, a great amount of ink is discharged from even an ink tank which has reached the user relatively soon after the manufacture of the same. That is, the running cost of any ink tank is increased. The problem becomes more significant in a configuration in which a suction process is performed on all printing heads at a time.

Under such circumstances, the present embodiment is intended to achieve efficient utilization of each ink by discharging inks in minimum required amounts at preliminary ejection before forming an image and performing preliminary ejection during a series of subsequent image forming operations in accordance with the degree of use of each ink.

Figure 5:
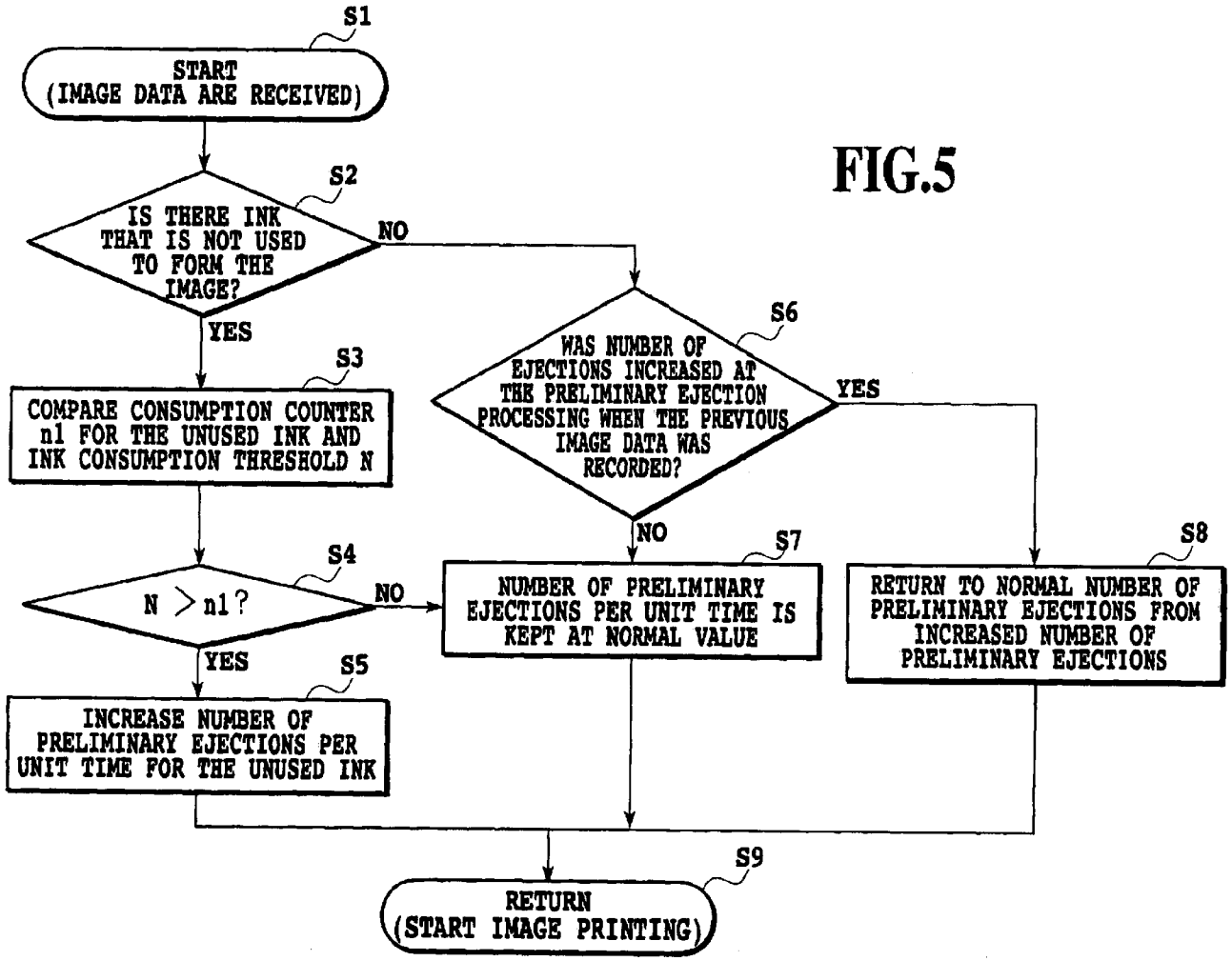
FIG. 5 is a flow chart showing steps of printing an image according to an embodiment of the invention.

FIG. 5 is a flow chart illustrating a flow of steps of printing an image including control of preliminary ejection. The series of image forming operations may be preceded by a discharge process which may be suction performed in a normal state of use.

Image data to be printed by a printer are received at step S1.

At step S2, a judgment is made on the received image data as to whether there is a type (color or density) of ink that is not to be used to form the image among the inks loaded on the printing heads. The judging means may make the judgment based on printing information such as a type of printing medium or a printing mode specified in association with the image data.

When it is judged at step S2 that there is an ink that is not to be used, a comparison is made at step S3 between the degree of use of the ink that is not used to form the image up to the current point in time, e.g., ink consumption n1 and a preset ink consumption threshold N specific to the ink.

When it is judged at step S4 that the current ink consumption n1 is smaller than the ink consumption threshold, the number of ejections per unit time during preliminary ejection of the ink that is not used to form the image is set at a value greater than a normal value at step S5, and printing is started at step S9 after the printing medium is fed.

It has been revealed that the pigment ink having the pigment density distribution shown in FIG. 3 provides a stable image when the image is formed after switching the number of ejections to a value which is about ten times the number of ejections in normal preliminary ejection during the image formation.

The switching of the number of preliminary ejections may be carried out by referring to a table of numbers of preliminary ejections that is prepared in advance in the printer main body. It may alternatively be carried out according to methods other than the use of a table.

When it is judged at step S4 that the current ink consumption n1 is greater than the ink consumption threshold, since it is considered that the ink has been consumed to enter a range of ink densities that allow stable image output, the number of ejections per unit time is set at step S7 such that normal preliminary ejections will be performed during image formation, and printing is started at step S9 after the printing medium is fed.

When it is judged at step S2 that all of the inks are to be used to form the image, it is detected at step S6 whether the number of preliminary ejections was switched when the previous image data was formed.

When it is judged at step S6 that the number of preliminary ejections was not switched when the previous image data was formed, the normal number of preliminary ejections is set as it is at step S7, and printing is started at step S9 after the printing medium is fed.

When it is judged at step S6 that the number of preliminary ejections was switched when the previous image data was formed, a setting is made at step S8 to restore the normal number of preliminary ejections, and printing is started at step S9 after the printing medium is fed.

It is judged at step S6 of the flow chart whether preliminary ejections were performed to discharge a great amount of ink when the previous image data was printed. As an alternative method, the switching from preliminary ejections to discharge a great amount of ink to normal preliminary ejections may be triggered by printing of image data and discharging of the printing medium performed after step S5 to delete steps S6 and S8.

In FIG. 5, ink consumption is detected; the detected value of ink consumption is compared with a predetermined value (a threshold that is set in advance based on an empirically determined elapsed time (e.g., one year after the manufacture of the cartridge) and preservation characteristics of the ink); the preliminary ejection process is performed to discharge a great amount of ink when the detected ink consumption is smaller than the preset ink threshold; and the normal preliminary ejection process is performed when the detected ink consumption is greater than the preset ink threshold. On the contrary, an alternative method may be employed in which the amount of remaining ink is detected as a degree of use of the ink; the detected value of remaining ink amount is compared with a preset threshold; a preliminary ejection process is performed to discharge a great a mount of ink when the detected amount of remaining ink is greater than the preset ink threshold; and a normal preliminary ejection process is performed when the detected amount of remaining ink is smaller than the preset ink threshold.

In FIG. 5, a method is employed in which the number of preliminary ejections per unit time is increased to discharge an ink in a high density that resides in an ink containing section. Alternatively, the amount of discharged ink may be increased by performing a preliminary ejection process at shorter time intervals or increasing the frequency of the preliminary ejection process. In the case of a printer having a configuration in which suction can be performed by joining cap units 300 with printing heads even when paper is fed as seen in the configuration in FIG. 1, the amount of discharged ink may be appropriately changed by discharging the ink using a suction process only or discharging the ink using a suction process and a preliminary ejection process in proper combination.

The consumption of a black ink is compared with a threshold that is set in advance based on preservation characteristics of the black ink in FIG. 5. The consumption of an ink in a different color may be similarly compared with a threshold that is set in advance based on preservation characteristics of the ink to allow switching between a normal preliminary ejection process and a preliminary ejection process to discharge a great amount of ink.

While FIG. 1 shows an inkjet printer installed with a plurality of ink tanks, it may be installed with a single ink tank.

As described above, the occurrence of image problems can be prevented when using an ink tank a long time after it has been manufactured by setting a threshold in advance based on changes in physical and chemical properties of the used ink depending on the period of preservation and the degree of use of the ink. Further, even when using an ink tank not so long after it has been manufactured, it is possible to prevent the ink from being discharged in an unnecessarily large amount. That is, by using discharge on a discrete basis depending on the degree of use of inks during image formation, an extreme increase in the running cost is avoided, which makes it possible to provide a printer with an improved running cost.

[Second Embodiment]

Some ink tanks or some ink cartridges as shown in FIG. 3 provided by integrating an ink tank and a printing head have a memory section (e.g., an EEPROM) in which information on the manufacturing date is stored. In the present embodiment, as described below, an ink consumption threshold specific to an ink as described in the first embodiment is set for an ink cartridge in which information on the manufacturing date is stored, the threshold being variable depending on the time that has passed since the time of manufacture. This makes it possible to provide a printer with an improved running cost.

In the case of such an ink cartridge described above, the point in time when the cartridge is installed is used to trigger and an internal timer of a printing apparatus, for example, can calculate the time elapsed from the manufacture of the cartridge to the installation of the same.

Figure 6:
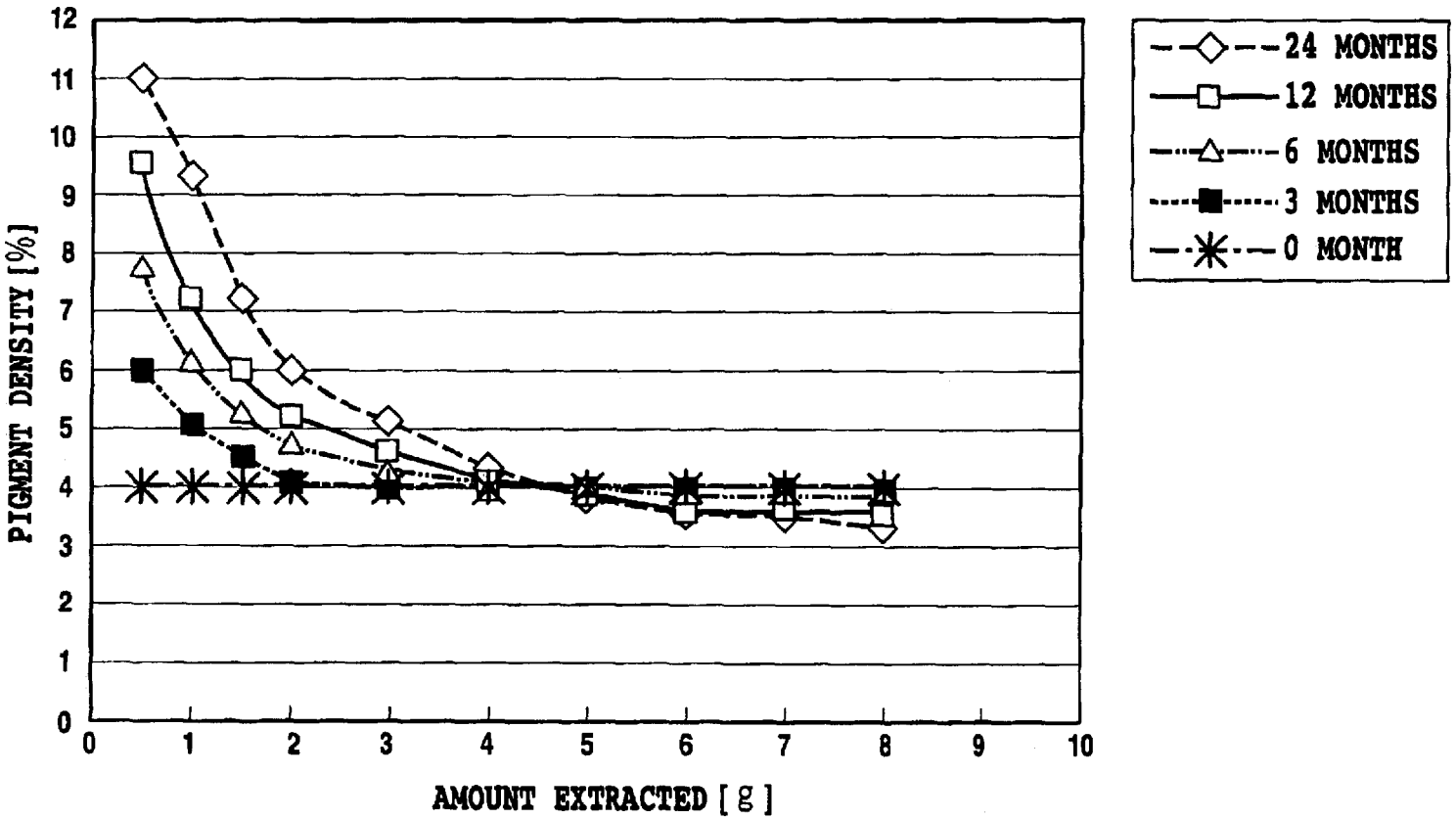
FIG. 6 is a graph showing distributions of pigment densities of a pigment ink having the same characteristics as those of the ink shown in FIG. 4, the distributions being observed by putting the ink in an ink tank configured such that its interior is fully occupied by a porous absorber in the form of a sponge contained therein to hold an ink with a capillary force thereof, letting the tank stand for 24, 12, 6, 3, and 0 months with an ink supply hole thereof facing downward, and extracting the ink from the ink supply hole.

FIG. 6 is a graph showing distributions of pigment densities of a pigment ink having the same characteristics as those of the ink shown in FIG. 4, the distributions being observed by putting the ink in an ink tank configured such that its interior is fully occupied by a porous absorber in the form of a sponge contained therein to hold an ink with a capillary force thereof, letting the tank stand for 24, 12, 6, 3, and 0 months with an ink supply hole thereof facing downward, and extracting the ink from the ink supply hole.

In the second embodiment, an ink consumption threshold is set for an ink tank as shown in FIG. 6 such that preliminary ejections as discharging means are performed until a density allowing stable ink ejection is achieved. The threshold is set according to information on the manufacturing date accompanying the ink tank or cartridge taking a density distribution that depends on the preservation period of the same into consideration.

FIG. 7 is a table for actually setting the ink consumption threshold according to the information on the manufacturing date accompanying the ink tank or cartridge based on FIG. 6. The table may be provided in a storage section of the cartridge or in a storage section (e.g., a ROM) of a main body of a printing apparatus. In either case, according to the present embodiment, the setting of the amount of ink discharged during a preliminary ejection process is changed based on a comparison between a threshold that is set based on the table and an actual amount of ink consumed after the ink tank or cartridge is installed on a printing head.

The setting of the discharging amount of ink by discharging means such as a preliminary ejection process may be changed when the ink tank or cartridge is installed on the printing head. Specifically, the setting for the change may be made (the setting may precede step S1 in FIG. 5, for example) based on a table, which is separately created and in which initial amounts to be extracted, each of which is a required minimum for achieving a stable ink density, are set, the initial amounts being set depending on elapsed times similar to those in FIG. 7. Thus, the amount discharged on a preliminary basis can be changed during a series of image forming operations as described above depending on the time that has passed since the time of manufacturing a cartridge with the initial amount discharged kept at the required minimum, which makes it possible to use each ink more efficiently and to achieve a further reduction of the running cost of each ink tank.

Further, the discharge of an ink is not limited to preliminary ejections, and an ink may be discharged using a suction process only or using a suction process and preliminary ejection process in proper combination like the first embodiment to change the amount discharged appropriately.

When an ink consumption threshold specific to an ink is thus set such that it can be varied depending on the time that has passed since the time of manufacture, no image problem occurs even when using an ink tank a long time after it has been manufactured. Further, even when using an ink tank not so long after it has been manufactured, there will be no increase in the running cost. This makes it possible to provide a printer with an improved running cost that depends on such an elapsed time.

In the above embodiments, descriptions were made on applications of the invention to a configuration employing an ink tank integral with a printing head. However, the invention may be applied to a configuration employing an ink tank that is provided separately from a printing head. Further, the invention can obviously be used regardless of printing methods, i.e., the serial method and the full-multi method. Referring to the element for generating energy to be used for ejecting an ink, the invention is not limited to the use of an electrothermal transducer, and an electromechanical energy transducer such as a piezoelectric element may be used.

As described above, in an inkjet recording apparatus utilizing an inkjet printing head and an ink tank for supplying ink to the inkjet printing head, the invention makes it possible to suppress image problems attributable to changes in physical and chemical properties of ink that occur during the time since it is manufactured and until it is put in use and to thereby provide reliable and stable images at a low running cost.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An inkjet printing apparatus for forming an image using a plurality of printing heads for ejecting ink and a plurality of ink containing sections for containing the ink to be supplied to the printing heads, the plurality of the printing heads and the ink containing sections being used in association with plural types of inks, comprising:

means for discharging the ink through an ink ejection opening of the printing heads to stabilize ink ejecting characteristics of the printing heads;

means for detecting the degree of use of the ink in the ink containing sections;

means for comparing the detected degree of use of the ink with a predetermined value;

control means for changing the amount discharged by said discharging means in accordance with the result of the comparison; and means for judging whether there is an ink that is not used to form an image when the image is formed, on the basis of the judgment result by said judging means, said detecting means detects the degree of use of the ink in the ink containing section containing the ink that is not used to form the image to contribute to the comparison with the predetermined value and the process of changing the amount discharged.

2. An inkjet printing apparatus as claimed in claim 1, wherein said detecting means detects the degree of use of the ink based on the consumption of the ink in the ink containing sections.

3. An inkjet printing apparatus as claimed in claim 1, wherein said detecting means detects the degree of use of the ink based on the amount of ink remaining in the ink containing sections.

4. An inkjet printing apparatus as claimed in claim 1, wherein said judging means judges whether there is an ink that is not used to form the image based on printing information in association with image data.

5. An inkjet printing apparatus as claimed in claim 1, wherein the predetermined value depends on the time that passes since a predetermined point in time that comes after the ink is stored in the ink containing sections.

6. An inkjet printing apparatus as claimed in claim 5, wherein the date of manufacture of the ink containing sections serves as a reference for the predetermined point in time.

7. An inkjet printing apparatus as claimed in claim 1, wherein said discharging means performs the discharging process by driving the printing heads to cause preliminary ejections of the ink.

8. An inkjet printing apparatus as claimed in claim 7, wherein said control means causes the discharging process to be performed during the formation of the image and changes the number of the preliminary ejections to change the amount discharged.

9. An inkjet printing apparatus as claimed in claim 7, wherein said control means causes the discharging process to be performed during the formation of the image and changes time intervals at which the discharging process is performed, thereby changing the amount discharged.

10. An inkjet printing apparatus as claimed in claim 1, wherein at least one of the inks includes a pigment as a coloring material.

11. An inkjet printing apparatus as claimed in claim 1, wherein at least one of the inks is a black ink.

* * * * *

UNITED STATES PATENT AND TRADEMARK OFFICE

CERTIFICATE OF CORRECTION

PATENT NO. : 6,945,623 B2
APPLICATION NO. : 10/625739
DATED : September 20, 2005
INVENTOR(S) : Atsushi Sakamoto et al.

It is certified that error appears in the above-identified patent and that said Letters Patent is hereby corrected as shown below:

The following minor errors have been noted in the above-identified patent:

Column 2, line 26, "some of" should read --some of the--.

Column 3, line 3, "both of" should read --both--; and

Line 12, "new" should read --a new--.

Column 5, line 57, "108(FIG. 2)." should read --108 (FIG. 2).--.

Column 8, line 2, "maybe" should read --may be --.

Column 9, line 48, "great a" should read --great--; and

Line 49, "mount" should read --amount--.

Column 10, line 39, "and an" should read --an--.

Signed and Sealed this

Twenty-sixth Day of December, 2006

JON W. DUDAS
*Director of the United States Patent and Trademark Office*